US009420883B2

(12) United States Patent
Lai

(10) Patent No.: US 9,420,883 B2
(45) Date of Patent: Aug. 23, 2016

(54) COMPOSITE SHELF

(71) Applicant: Chih-Cheng Lai, Xiushui Township, Changhua County (TW)

(72) Inventor: Chih-Cheng Lai, Xiushui Township, Changhua County (TW)

( * ) Notice: Subject to any disclaimer, the term of this patent is extended or adjusted under 35 U.S.C. 154(b) by 147 days.

(21) Appl. No.: 14/331,266

(22) Filed: Jul. 15, 2014

(65) Prior Publication Data

US 2016/0015173 A1 Jan. 21, 2016

(51) Int. Cl.
*A47B 47/00* (2006.01)

(52) U.S. Cl.
CPC ..... *A47B 47/005* (2013.01); *A47B 47/0016* (2013.01); *A47B 47/0033* (2013.01)

(58) Field of Classification Search
CPC ..... A47B 57/265; A47B 57/545; A47B 87/0223; A47B 87/0215; A47B 87/008; A47B 87/0207; A47B 87/0246; A47B 2087/023; A47B 2087/0238; A47B 47/0083; A47B 47/0033; A47B 2087/005; A47B 2087/0016; F16B 12/42; F16B 12/20; F16B 12/28; F16B 12/52
USPC ..... 211/188; 108/147.13, 190, 192
See application file for complete search history.

(56) References Cited

U.S. PATENT DOCUMENTS 3,747,965 A * 7/1973 Wing ..... A47F 5/14 211/182
4,138,953 A * 2/1979 Tashman ..... A47B 57/265 108/147.13
4,158,336 A * 6/1979 Brescia ..... A47B 87/0215 108/156
4,585,365 A * 4/1986 Manno ..... F16B 12/20 108/153.1
4,656,952 A * 4/1987 Schweizer ..... A47B 57/265 108/11
5,205,630 A * 4/1993 Welch ..... A47B 47/021 108/107
5,348,170 A * 9/1994 Thornley ..... A47B 57/20 108/107
5,628,256 A * 5/1997 Lazarus ..... A47B 47/0083 108/110
5,964,163 A * 10/1999 Cohen ..... A47B 49/004 108/186
6,123,035 A * 9/2000 Pfister ..... A47B 87/0223 108/147.13
6,202,867 B1 * 3/2001 Di Blasi ..... A47B 47/0075 108/138
9,084,484 B2 * 7/2015 Vilkomirski ..... A47B 87/0215
2004/0040922 A1 * 3/2004 Ko ..... A47B 81/04 211/153
2013/0048588 A1 * 2/2013 Vilkomirski ..... A47B 87/0215 211/153

* cited by examiner

*Primary Examiner* — Patrick Hawn
(74) *Attorney, Agent, or Firm* — Alan D. Kamrath; Kamrath IP Lawfirm, P.A.

(57) ABSTRACT

A composite shelf includes a plurality of connecting units, a plurality of supporting units mounted between the connecting units, and a plurality of upright posts connected with the connecting units. Each of the connecting units includes a connector provided with a plurality of slots to allow insertion of the supporting units. The connector of each of the connecting units is provided with a plurality of positioning grooves. Each of the connecting units further includes a plurality of positioning bars mounted in the positioning grooves of the connector and two positioning sleeves mounted on the connector and abutting the positioning bars. Thus, the supporting units are positioned by the positioning bars and locked by the positioning sleeves so that the supporting units are locked by and will not be detached from the connecting units.

6 Claims, 8 Drawing Sheets

COMPOSITE SHELF

BACKGROUND OF THE INVENTION

1. Field of the Invention

The present invention relates to a shelf and, more particularly, to a composite shelf.

2. Description of the Related Art

A conventional composite shelf in accordance with the prior art shown in FIG. 8 comprises a plurality of supporting units 4 and a plurality of connecting units 5 connected between the supporting units 4. Each of the supporting units 4 includes a frame 42 having a plurality of corners 46 and a plastic board 41 connected with the frame 42. The plastic board 41 of each of the supporting units 4 has a plurality of connecting portions 43 each formed with a mounting hole 44 mounted on the frame 42. Each of the connecting portions 43 of the plastic board 41 of each of the supporting units 4 has a fixing end 45 secured on the plastic board 41. Each of the connecting units 5 includes a circular body 51, and a plurality of ribs 52 and 53 formed on and protruded from the circular body 51. The ribs 52 and 53 of each of the connecting units 5 are arranged in a cross-shaped manner and are formed with slots 54 and 55 which are provided with a plurality of protruding strips 56. In assembly, the slots 54 and 55 of each of the connecting units 5 are mounted on the corners 46 of the frame 42 of each of the supporting units 4 so that the supporting units 4 are combined together by the connecting units 5. At this time, the protruding strips 56 of each of the connecting units 5 abut the corners 46 of the frame 42 of each of the supporting units 4. However, the corners 46 of the frame 42 of each of the supporting units 4 are not locked by the slots 54 and 55 of each of the connecting units 5 so that the corners 46 of the frame 42 of each of the supporting units 4 are easily detached from the slots 54 and 55 of each of the connecting units 5, thereby dismantling the supporting units 4 from the connecting units 5.

BRIEF SUMMARY OF THE INVENTION

In accordance with the present invention, there is provided a composite shelf comprising a plurality of connecting units, a plurality of supporting units transversely mounted between the connecting units, and a plurality of upright posts connected with the connecting units. Each of the connecting units includes a connector. The connector of each of the connecting units is provided with a resting portion. The connector of each of the connecting units is provided with a plurality of slots to allow insertion of the supporting units respectively. The connector of each of the connecting units is provided with a plurality of positioning grooves each traversing the respective slot.

Preferably, each of the connecting units further includes a plurality of positioning bars mounted on the connector. The positioning bars of each of the connecting units are respectively mounted in the positioning grooves of the connector and abut the supporting units respectively.

Preferably, each of the connecting units further includes two positioning sleeves mounted on the connector and abutting the positioning bars. The positioning sleeves of each of the connecting units are mounted on upper and lower ends of the connector and abut the resting portion of the connector. The positioning sleeves of each of the connecting units press upper and lower ends of each of the positioning bars to position the positioning bars respectively and to lock the supporting units respectively.

Preferably, each of the positioning sleeves of each of the connecting units protrudes outward from the connector and has a mounting hole to allow insertion of the respective upright post. Each of the upright posts is inserted into the mounting hole of each of the positioning sleeves of each of the connecting units.

Preferably, each of the positioning sleeves of each of the connecting units is hollow and has a configuration matching that of the connector.

Preferably, the resting portion of the connector of each of the connecting units protrudes outward from and surrounds a periphery of the connector.

Preferably, the slots of the connector of each of the connecting units are located at and transversely extended through corners of the resting portion.

Preferably, each of the positioning grooves of the connector of each of the connecting units extends in a longitudinal direction of the connector and extends through the resting portion.

According to the primary advantage of the present invention, the bending portions of the frame of each of the supporting units are positioned by the positioning bars of each of the connecting units, and locked by the positioning sleeves of each of the connecting units, so that the supporting units are locked by and will not be detached from the connecting units, thereby solidifying and stabilizing the composite shelf.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
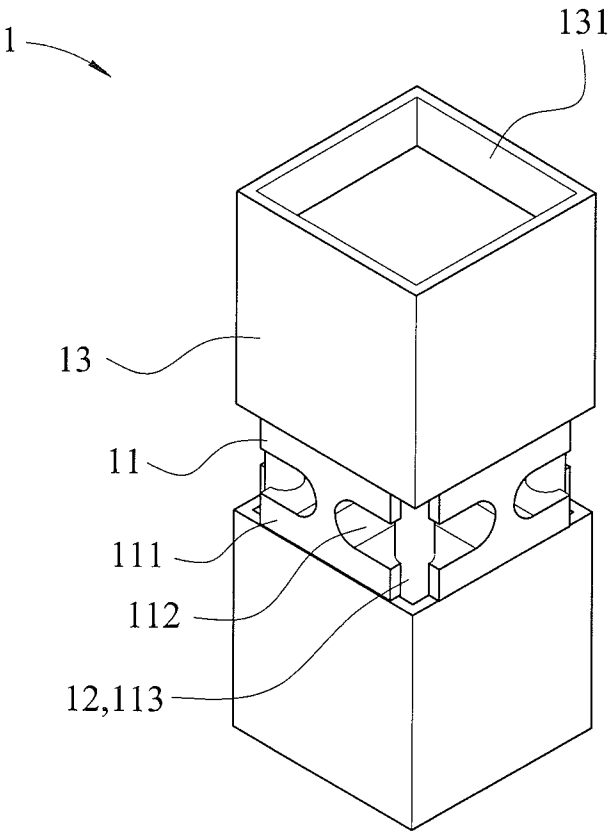
FIG. 1 is a perspective view of a connecting unit of a composite shelf in accordance with the preferred embodiment of the present invention.
Figure 2:
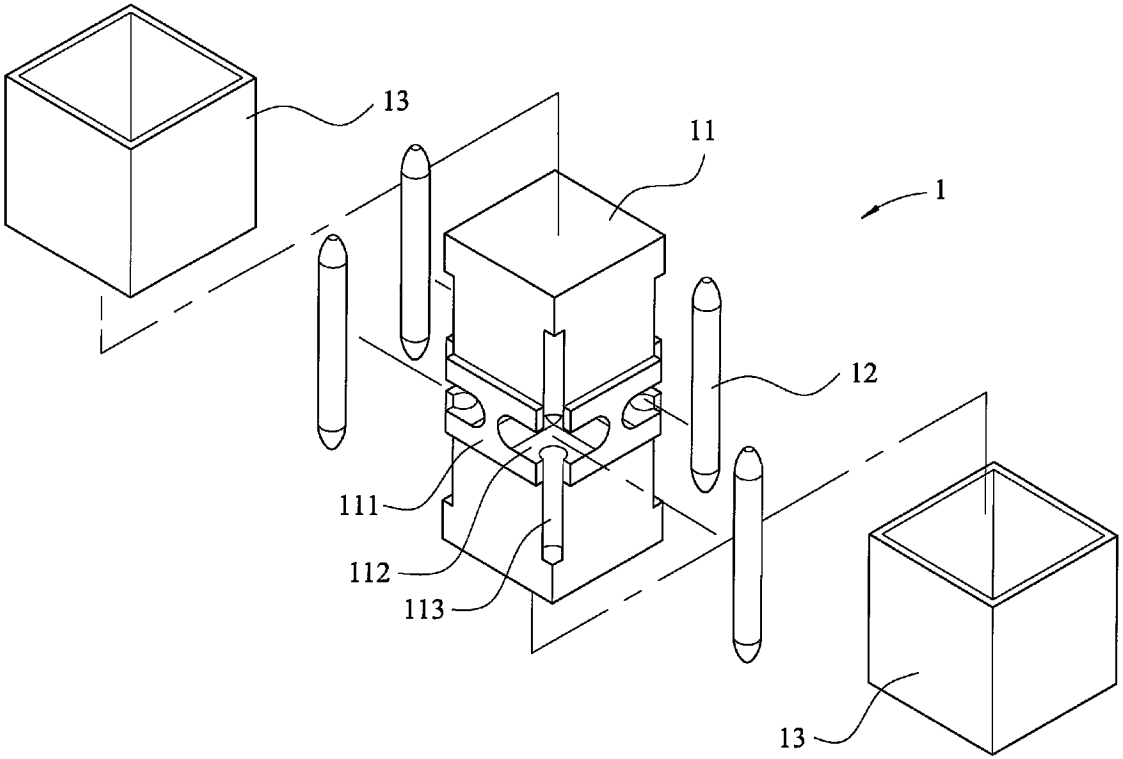
FIG. 2 is an exploded perspective of the connecting unit of the composite shelf as shown in FIG. 1.
Figure 3:
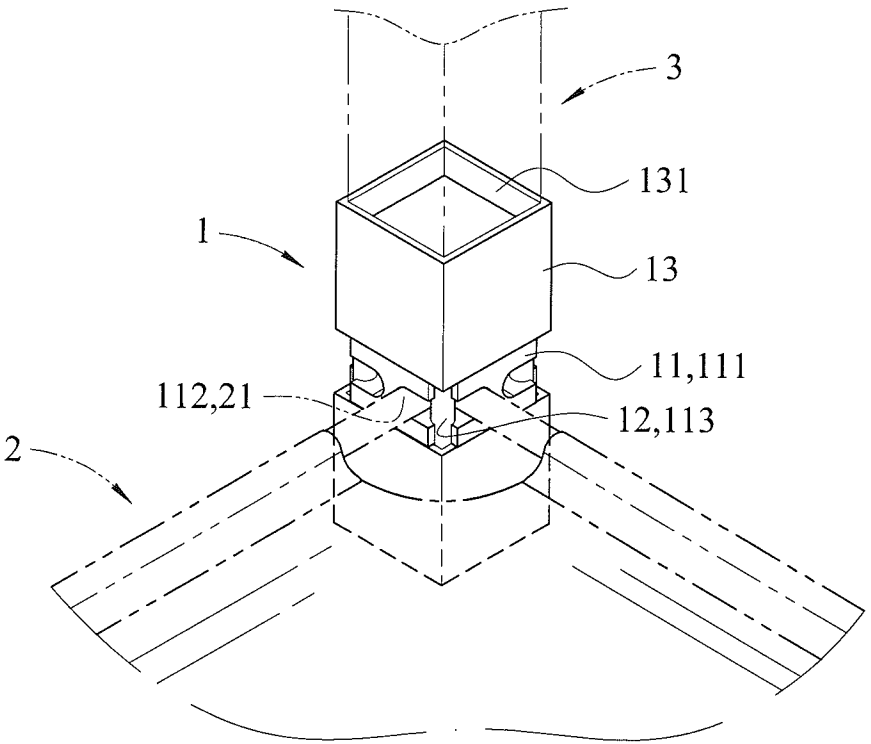
FIG. 3 is a partially perspective view of the composite shelf in accordance with the preferred embodiment of the present invention.
Figure 4:
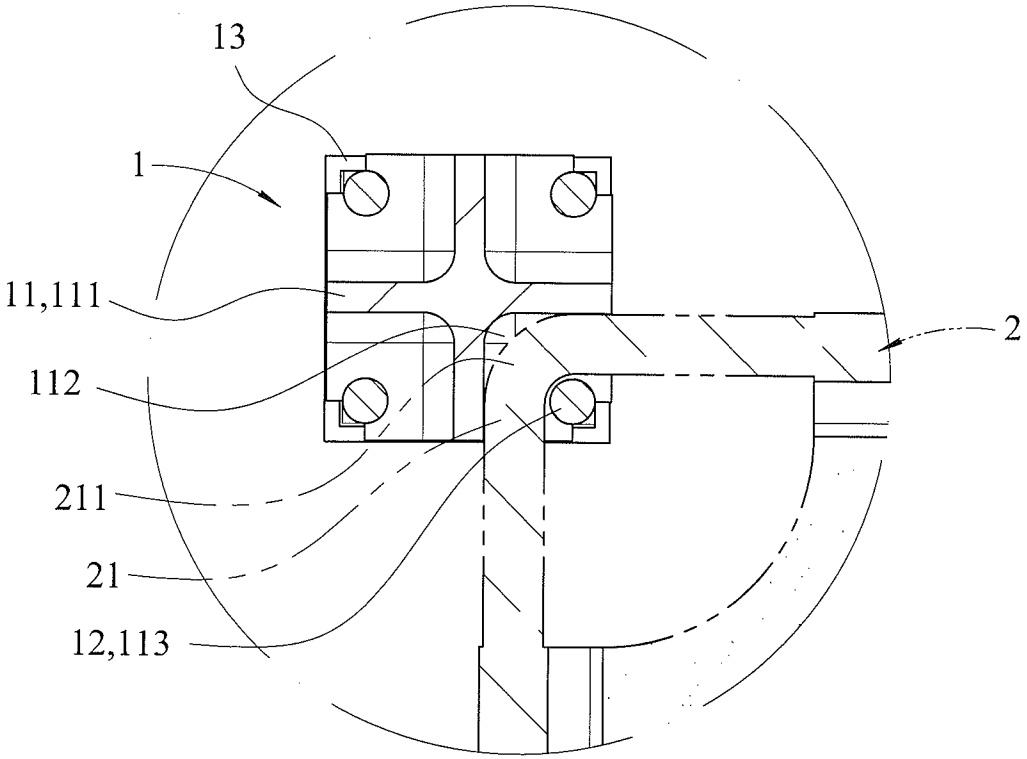
FIG. 4 is a top cross-sectional view of the composite shelf as shown in FIG. 3.

Referring to the drawings and initially to FIGS. 1-5, a composite shelf "A" in accordance with the preferred embodiment of the present invention comprises a plurality of connecting units 1, a plurality of supporting units 2 transversely mounted between the connecting units 1, and a plurality of upright posts 3 connected with the connecting units 1.

Each of the connecting units 1 includes a connector 11, a plurality of positioning bars 12 mounted on the connector 11, and two positioning sleeves 13 mounted on the connector 11 and abutting the positioning bars 12.

The connector 11 of each of the connecting units 1 preferably has a square, circular, rectangular or polygonal shape. The connector 11 of each of the connecting units 1 is made of metallic or plastic material and is provided with a resting portion 111. The resting portion 111 of the connector 11 of each of the connecting units 1 protrudes outward from and surrounds a periphery of the connector 11. The connector 11 of each of the connecting units 1 is provided with a plurality of slots 112 to allow insertion of the supporting units 2 respectively. The slots 112 of the connector 11 of each of the connecting units 1 are located at and transversely extended through corners of the resting portion 111. The connector 11 of each of the connecting units 1 is provided with a plurality of positioning grooves 113 each traversing the respective slot 112. Each of the positioning grooves 113 of the connector 11 of each of the connecting units 1 extends in a longitudinal direction of the connector 11 and extends through the resting portion 111.

The positioning bars 12 of each of the connecting units 1 are respectively mounted in the positioning grooves 113 of the connector 11 and abut the supporting units 2 respectively. Each of the positioning bars 12 of each of the connecting units 1 is made of metallic or plastic material and has a configuration matching that of each of the positioning grooves 113 of the connector 11.

The positioning sleeves 13 of each of the connecting units 1 are mounted on upper and lower ends of the connector 11 and abut the resting portion 111 of the connector 11. The positioning sleeves 13 of each of the connecting units 1 press upper and lower ends of each of the positioning bars 12 to position the positioning bars 12 respectively and to lock the supporting units 2 respectively. Each of the positioning sleeves 13 of each of the connecting units 1 is made of metallic or plastic material. Each of the positioning sleeves 13 of each of the connecting units 1 is hollow and has a configuration matching that of the connector 11. Preferably, each of the positioning sleeves 13 of each of the connecting units 1 has a square, circular, rectangular or polygonal shape. Each of the positioning sleeves 13 of each of the connecting units 1 protrudes outward from the connector 11 and has a mounting hole 131 to allow insertion of the respective upright post 3.

Figure 5:
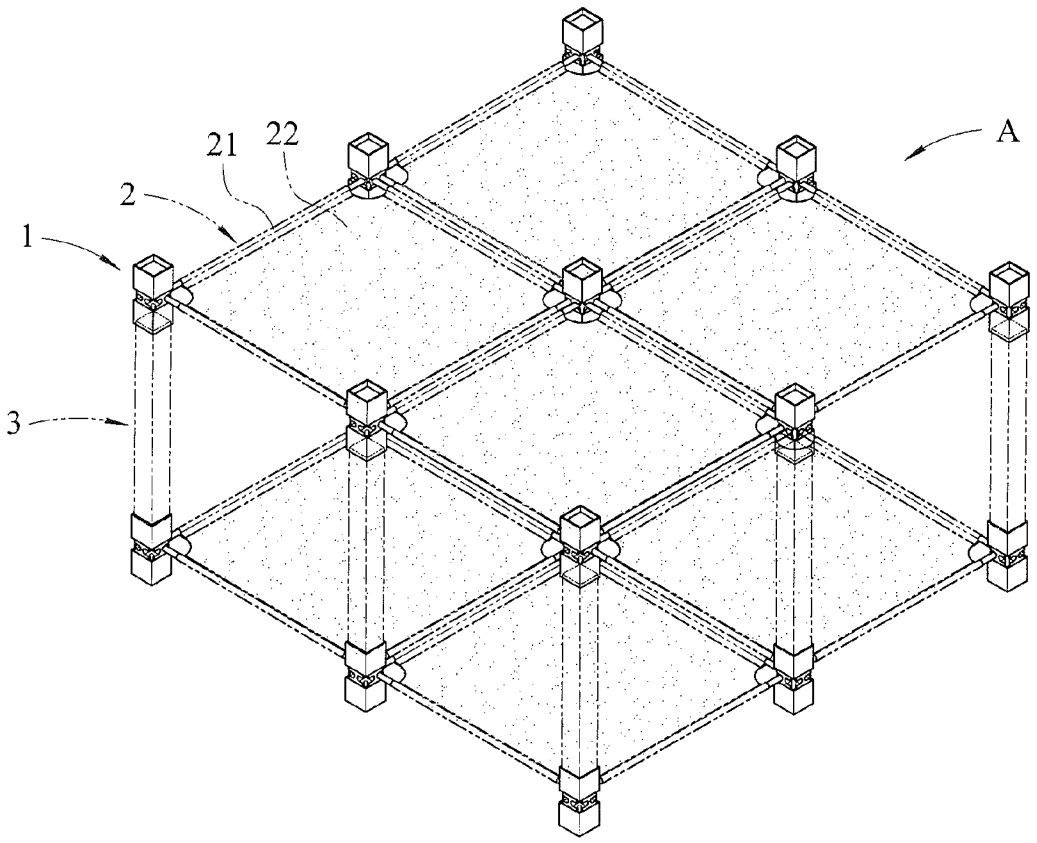
FIG. 5 is a perspective view of the composite shelf in accordance with the preferred embodiment of the present invention.
Figure 6:
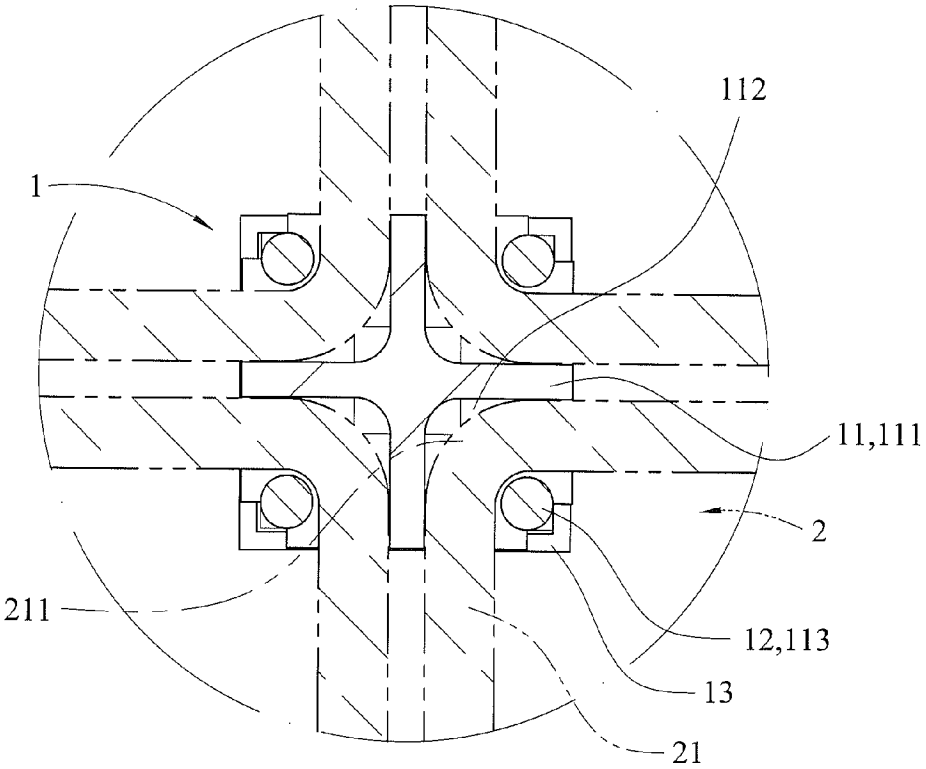
FIG. 6 is a top cross-sectional view of the composite shelf as shown in FIG. 5.
Figure 7:
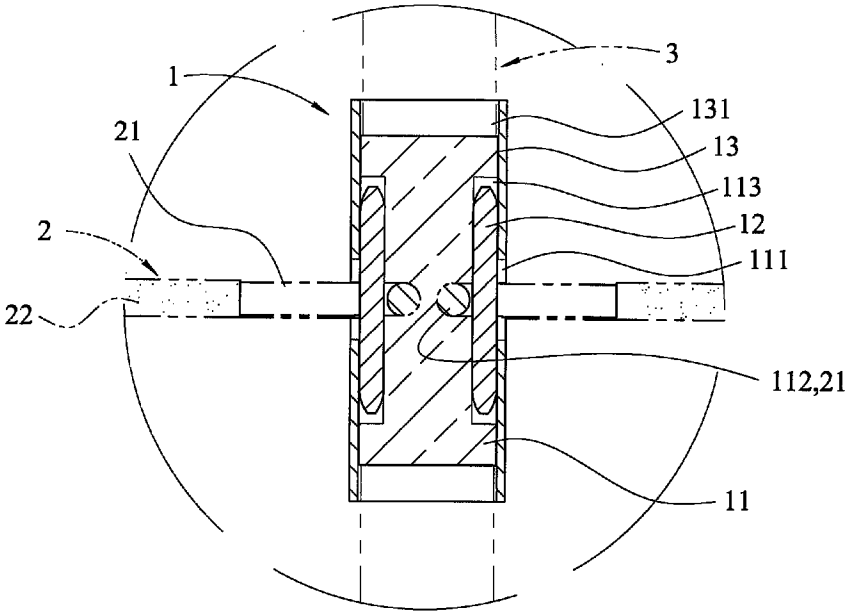
FIG. 7 is a front cross-sectional view of the composite shelf as shown in FIG. 5.
Figure 8:
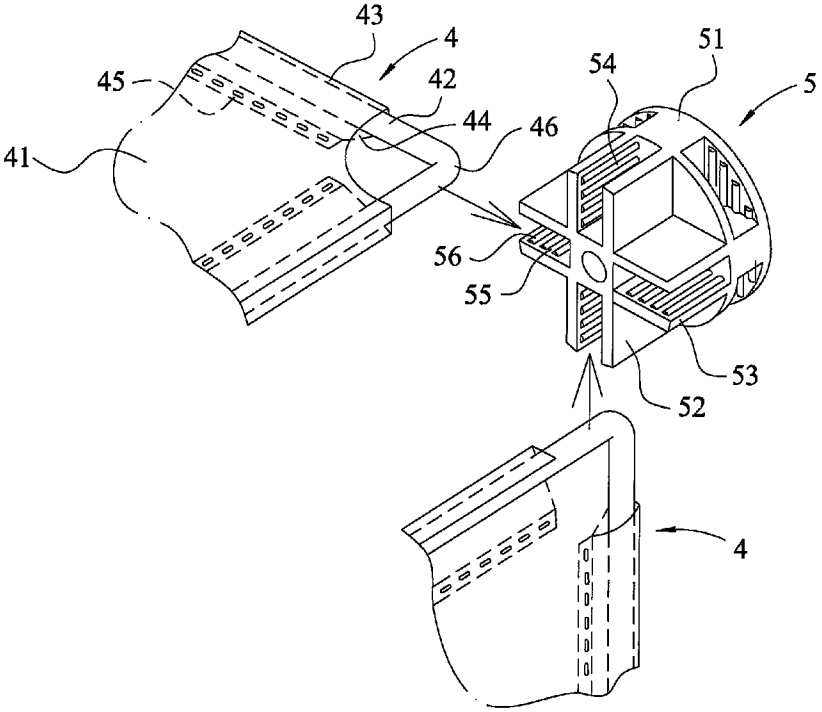
FIG. 8 PRIOR ART
FIG. 8 is a partially exploded perspective view of a conventional composite shelf in accordance with the prior art.

Referring to FIGS. 5-7 with reference to FIGS. 1-4, each of the supporting units 2 includes a frame 21 mounted between the connecting units 1 and a plate 22 mounted on the frame 21. The frame 21 of each of the supporting units 2 is made of metallic or plastic material and is formed with a plurality of bending portions 211 respectively mounted in the slots 112 of the connector 11 of each of the connecting units 1 and respectively positioned by the positioning bars 12 of each of the connecting units 1. Each of the bending portions 211 of the frame 21 of each of the supporting units 2 has a configuration matching that of each of the slots 112 of the connector 11 of each of the connecting units 1. The plate 22 of each of the supporting units 2 is made of plastic or cloth material. Each of the upright posts 3 is made of metallic or plastic material and is inserted into the mounting hole 131 of each of the positioning sleeves 13 of each of the connecting units 1.

In assembly, the bending portions 211 of the frame 21 of each of the supporting units 2 are respectively mounted in the slots 112 of the connector 11 of each of the connecting units 1. Then, the positioning bars 12 of each of the connecting units 1 are respectively mounted in the positioning grooves 113 of the connector 11 and abut the bending portions 211 of the frame 21 of each of the supporting units 2 respectively as shown in FIG. 6, so that the bending portions 211 of the frame 21 of each of the supporting units 2 are respectively positioned by the positioning bars 12 of each of the connecting units 1, and the supporting units 2 are limited by the connecting units 1. Then, the positioning sleeves 13 of each of the connecting units 1 are mounted on upper and lower ends of the connector 11 and abut the resting portion 111 of the connector 11. At this time, the positioning sleeves 13 of each of the connecting units 1 press upper and lower ends of each of the positioning bars 12 to position the positioning bars 12 respectively and to position the bending portions 211 of the frame 21 of the supporting units 2 respectively so that the supporting units 2 are locked by the connecting units 1. Then, each of the upright posts 3 is inserted into the mounting hole 131 of each of the positioning sleeves 13 of each of the connecting units 1 as shown in FIG. 7. Thus, the connecting units 1, the supporting units 2 and the upright posts 3 are in turn connected successively to construct the composite shelf "A" as shown in FIG. 5.

Accordingly, the bending portions 211 of the frame 21 of each of the supporting units 2 are positioned by the positioning bars 12 of each of the connecting units 1, and locked by the positioning sleeves 13 of each of the connecting units 1, so that the supporting units 2 are locked by and will not be detached from the connecting units 1, thereby solidifying and stabilizing the composite shelf "A".

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. A composite shelf comprising:

a plurality of connecting units;

a plurality of supporting units transversely mounted between the plurality of connecting units; and a plurality of upright posts connected with the plurality of connecting units, wherein:

each of the plurality of connecting units includes a connector, a plurality of positioning bars mounted on the connector, and two positioning sleeves mounted on the connector and abutting the plurality of positioning bars;

the connector of each of the plurality of connecting units is provided with a resting portion;

the connector of each of the plurality of connecting units is provided with a plurality of slots to allow insertion of the plurality of supporting units respectively;

the connector of each of the plurality of connecting units is provided with a plurality of positioning grooves each traversing a respective slot;

the plurality of positioning bars of each of the plurality of connecting units is respectively mounted in the plurality of positioning grooves of the connector and abut the plurality of supporting units respectively;

the two positioning sleeves of each of the plurality of connecting units are mounted on upper and lower ends of the connector and abut the resting portion of the connector; and the two positioning sleeves of each of the plurality of connecting units press upper and lower ends of each of the plurality of positioning bars to position the plurality of positioning bars respectively and to lock the plurality of supporting units respectively.

2. The composite shelf of claim 1, wherein:

each of the two positioning sleeves of each of the plurality of connecting units protrudes outward from the connector and has a mounting hole to allow insertion of a respective upright post; and each of the plurality of upright posts is inserted into the mounting hole of each of the two positioning sleeves of each of the plurality of connecting units.

3. The composite shelf of claim 2, wherein each of the two positioning sleeves of each of the plurality of connecting units is hollow and has a configuration to abut and rest on the connector.

4. The composite shelf of claim 1, wherein the resting portion of the connector of each of the plurality of connecting units protrudes outward from and surrounds a periphery of the connector.

5. The composite shelf of claim 1, wherein the plurality of slots of the connector of each of the plurality of connecting units are located at and transversely extend through corners of the resting portion.

6. The composite shelf of claim 1, wherein each of the plurality of positioning grooves of the connector of each of the plurality of connecting units extends in a longitudinal direction of the connector and extends through the resting portion.

* * * * *